US007896274B2

(12) United States Patent
Roozeboom

(10) Patent No.: US 7,896,274 B2
(45) Date of Patent: Mar. 1, 2011

(54) MACHINE WITH SNAG ANVIL

(75) Inventor: Keith Leon Roozeboom, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 1410 days.

(21) Appl. No.: 11/343,961

(22) Filed: Jan. 30, 2006

(65) Prior Publication Data

US 2007/0176034 A1 Aug. 2, 2007

(51) Int. Cl.
*B02C 13/00* (2006.01)
*B02C 23/02* (2006.01)

(52) U.S. Cl. ..... 241/186.35; 241/189.1

(58) Field of Classification Search ..... 241/186.3, 241/186.35, 186.4, 189.1
See application file for complete search history.

(56) References Cited

U.S. PATENT DOCUMENTS

| | | | | |
|---|---|---|---|---|
| 3,542,302 | A | 11/1970 | Salzmann, Jr. | |
| 3,861,602 | A | 1/1975 | Smith | |
| 4,049,206 | A | 9/1977 | Konig et al. | |
| 4,449,673 | A * | 5/1984 | Cameron | 241/186.35 |
| 4,773,601 | A | 9/1988 | Urich et al. | |
| 5,005,620 | A | 4/1991 | Morey | |
| 5,692,548 | A | 12/1997 | Bouwers et al. | |
| 5,692,549 | A | 12/1997 | Eggers | |
| 5,803,380 | A | 9/1998 | Brand et al. | |
| 5,947,395 | A | 9/1999 | Peterson et al. | |
| 5,975,443 | A | 11/1999 | Hundt et al. | |
| 6,116,529 | A * | 9/2000 | Fisher et al. | 241/101.763 |
| 6,189,820 | B1 * | 2/2001 | Young | 241/186.3 |
| 6,290,115 | B1 | 9/2001 | Chen | |
| 6,299,082 | B1 | 10/2001 | Smith | |
| 6,422,495 | B1 | 7/2002 | De Boef et al. | |
| 6,637,680 | B1 * | 10/2003 | Young et al. | 241/30 |
| 6,840,471 | B2 | 1/2005 | Roozeboom et al. | |
| 6,871,807 | B2 * | 3/2005 | Rossi, Jr. | 241/101.72 |
| 7,011,258 | B2 | 3/2006 | O'Halloran et al. | |
| 7,077,345 | B2 | 7/2006 | Byram et al. | |
| 7,441,719 | B2 | 10/2008 | Verhoef et al. | |
| 7,448,567 | B2 | 11/2008 | Roozeboom | |
| 7,461,802 | B2 | 12/2008 | Smidt et al. | |
| 7,461,832 | B2 | 12/2008 | Zhang | |
| 2005/0184178 | A1 | 8/2005 | Smidt et al. | |
| 2008/0061176 | A1 | 3/2008 | Smith | |

FOREIGN PATENT DOCUMENTS

| | | |
|---|---|---|
| WO | WO2008/140953 | 11/2008 |

* cited by examiner

*Primary Examiner* — Jimmy T Nguyen
(74) *Attorney, Agent, or Firm* — Merchant & Gould P.C.

(57) ABSTRACT

A machine having a snag anvil that prevents an excessive intake rate of material into a grinding or chipping chamber of the machine. The snag anvil includes a recessed impact plane located between longitudinal edges that snag material entering the grinding chamber at an excess intake rate. The machine also includes an open feed roller constructed to prevent material plugging, and a sealing arrangement that eliminates the build up of chip piles underneath the machine.

27 Claims, 6 Drawing Sheets

MACHINE WITH SNAG ANVIL

TECHNICAL FIELD

The present disclosure relates generally to machines that grind, shred, and/or chip various types of material. More particularly, this disclosure relates to components for use on machines having a conveying system that convey various types of material to a grinding, shredding, and/or chipping chamber.

BACKGROUND

Machines, such as grinders and chippers, are used both commercially and non-commercially for shredding, grinding, and/or chipping a variety of materials. Grinders, for example, typically include a grinding chamber having a grinding drum, and a conveying system that transports the various materials to the grinding chamber. Many conventional grinders have an anvil positioned adjacent to the conveying system at a location just prior to where the material enters the grinding chamber. The anvil provides a solid surface that accommodates impact forces, produced by tips or hammers of the grinding drum, and transferred through the material being ground.

In use, material is fed into the grinding chamber of conventional machines at a feed rate generally dictated by the speed of the conveying system. The speed of the conveying system is set to correspond to the machine's grinding capacity. In some circumstances, the rotational motion of the grinding drum and the hammers can cause the hammers or tips to grip and pull the conveyed material into the grinding chamber at a rate that exceeds the machine's grinding capacity. When the incoming material is pulled into the grinding chamber at too great a rate, the machine can plug, reducing the grinding efficiency of the machine, and even causing the machine to stall.

The conveying system of some conventional grinders includes a lower feed conveyor and an upper roller. The upper roller, in cooperation with the lower feed conveyor, functions to transport the material to the grinding chamber. The upper roller is often partly enclosed by a shroud or shoot having sidewalls. On some occasions, material is forced between the roller and the shroud sidewalls, and collects within a volume located at the open ends of the roller. The material becomes trapped within open ends of the roller due to the proximity of the roller ends to shroud sidewalls. As material collects within the open ends of the roller, the increasing volume of material within the roller begins to drag or scrape against the sidewalls, and can sometimes jam between the roller and the sidewall. The collected, trapped material creates an undesirable drag on the conveying system, and can even subsequently stall the conveying system.

The region adjacent to the conveying system and just prior to where the material enters the grinding chamber is often referred to as a transition region. In some conventional arrangements, the transition region includes a transition plate located adjacent to the lower feed conveyor. A gap or opening exists between the transition plate and the lower feed conveyor of conventional machines. During operation, chips and other small pieces of material often fall through the opening. The pile of material that builds up underneath the machine requires a user to expend extra time and effort in clean up and maintenance of a work site.

In general, improvement has been sought with respect to such conventional grinder machines, generally to address the problems previously described.

SUMMARY

One feature of the present disclosure relates to a snag anvil, a machine that incorporates the snag anvil, and associated methods. In one aspect, the snag anvil includes first and second longitudinal edges positioned along opposite sides of a recessed impact plane. In another aspect, the anvil is a reversible anvil. In yet another aspect, the longitudinal edges of the anvil are located a distance above the recessed impact plane, and flush with a conveying plane of a grinding machine.

Another feature of the present disclosure relates to an upper feed roller of a conveying system. The upper feed roller includes large openings that allow material to pass through the roller, and prevent the collection of material within an interior region of the roller.

Still another feature of the present disclosure relates to a sealing arrangement that can be used to prevent chips and material from falling to the ground between a grinding machine's conveying system and grinding chamber.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Reference will now be made in detail to various features of the present disclosure that are illustrated in the accompanying drawings. Wherever possible, the same reference numbers will be used throughout the drawings to refer to the same or like parts.

Figure 1:
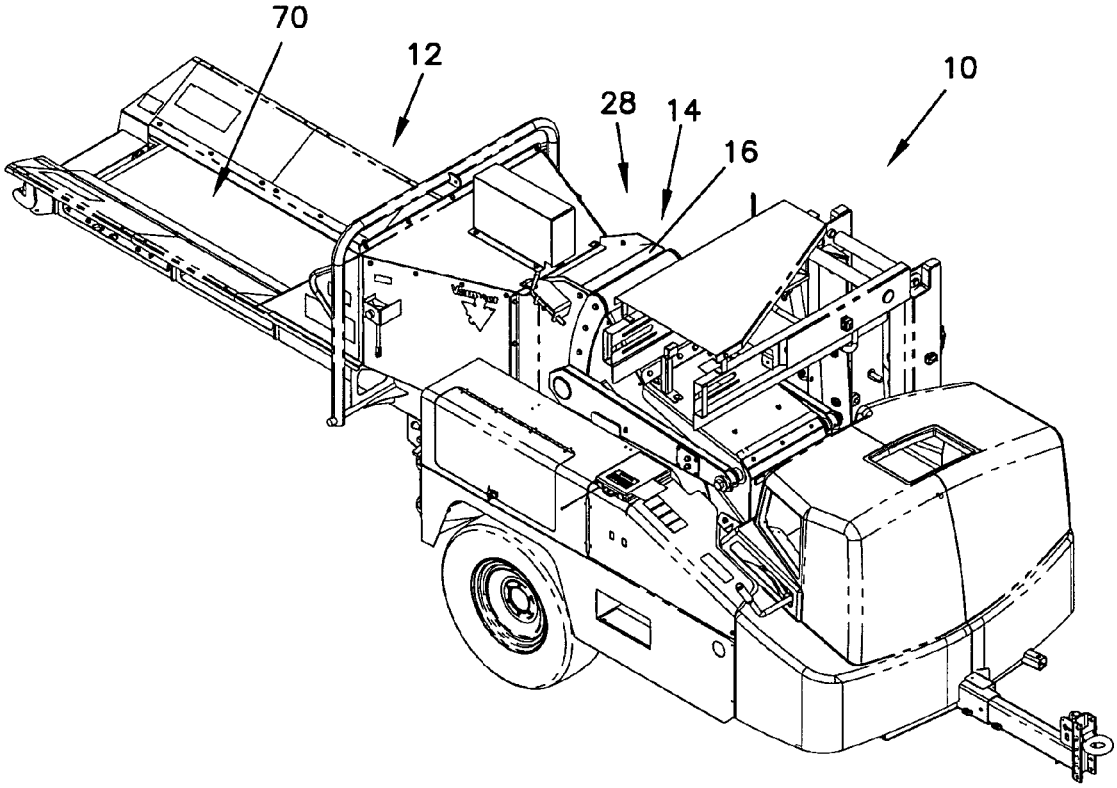
FIG. 1 is a perspective view of one embodiment of a grinding machine incorporating the features presently disclosed.

FIG. 1 illustrates one embodiment of a grinding machine 10 having features that are examples of how inventive aspects in accordance with the principles of the present disclosure may be practiced. Although the present disclosure is described in relation to a grinding machine, it is to be understood that the term "grinding" machine is used for explanatory purposes only. Applying the present principles to machines having different nomenclature, yet having similar theories of operation, such as chipper machines for example, is within the scope of the present disclosure.

The grinding machine 10 of FIG. 1 generally includes a material conveying system 12 that transports or conveys various materials toward a grinding chamber 14 of the machine. Preferred features of the grinding machine 10 are adapted for preventing an undesired rapid feed rate of material into the grinding chamber 14; preventing an undesirable operating condition and/or subsequent stalling of the conveying system 12; and eliminating undesired chip or material buildup underneath the grinding machine 10.

Figure 2:
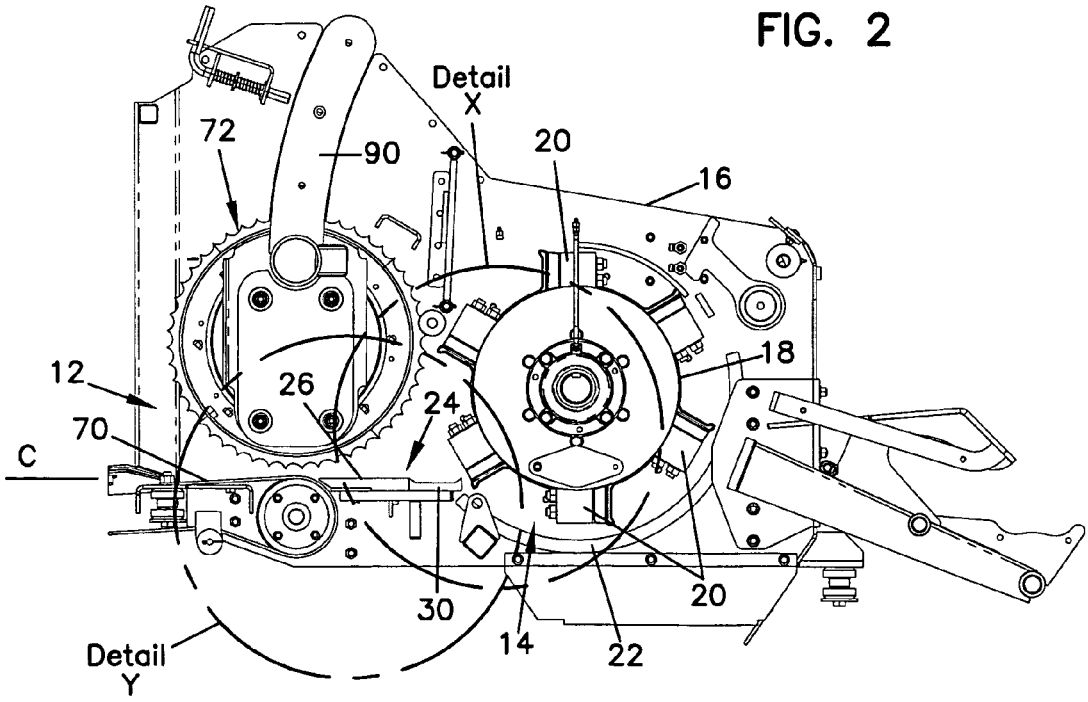
FIG. 2 is a partial side view of the grinding machine of FIG. 1, illustrating one embodiment of an anvil, an upper feed roller, and a sealing arrangement, in accordance with the principles disclosed.

Referring to FIG. 2, the grinding chamber 14 of the grinding machine 10 is partially enclosed by a housing or shroud 16. A grinding drum 18 is located within the partially enclosed grinding chamber 14. A plurality of hammers 20 extends radially outward from the drum 18. During operation, the drum 18 rotates about a central axis A (FIG. 3) while material is transported by the conveying system 12 toward the rotating hammers 20 of the drum. The impact from the rotating hammers 20 on the material shreds, chips, and/or grinds the transported material. The ground material exits the grinding chamber 14 through a screen 22, and can then be conveyed away from the grinding machine for disposal or other use.

I. Snag Anvil

Figure 3:
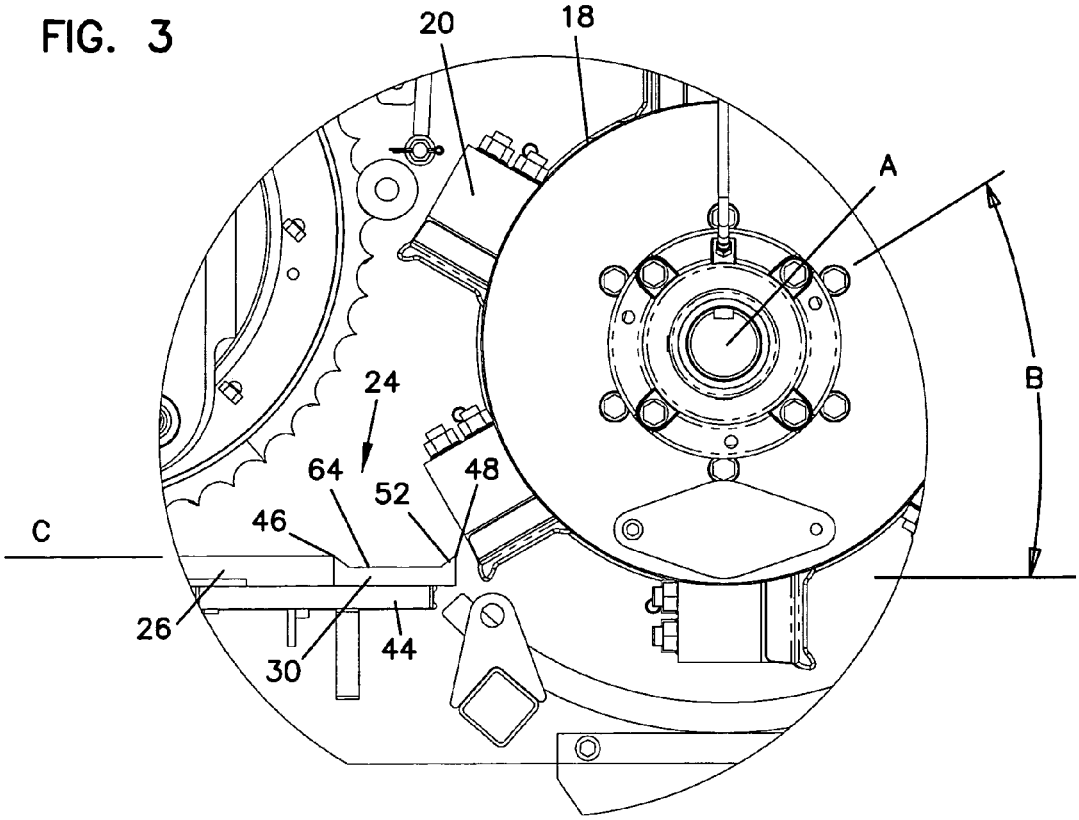
FIG. 3 is an enlarged, detailed view of the grinding machine of FIG. 2, taken from circled detail X.

Referring now to FIGS. 2 and 3, one feature of the present grinding machine 10 relates to a snag anvil 30 that is adapted to prevent an undesired rapid feed rate of material into the grinding chamber 14 of the grinding machine 10. The snag anvil 30 is located in a transition region 24 of the grinding machine, i.e., the region 24 between the conveyor system 12 and the grinding chamber 14. The transition region 24 includes a stationary transition plate 26 and the anvil 30. The anvil 30 is positioned adjacent to the drum 18 to accommodate impact forces produced by the hammers 20 and transferred through the material.

The snag anvil 30 of the present disclosure is constructed to reduce the occurrence of exceeding a desired incoming material feed rate. The desired incoming material feed rate, or material intake rate, can be exceed when grinding tips of a drum catch and pull material into the grinding chamber at a rate too fast for the grinding chamber to handle. The present anvil 30 prevents excessive material intake rates by snagging or slowing material at a point just prior to entry into the grinding chamber 14. This provides a more controlled and uniform flow of material into the grinding chamber 14 so that the hammers can effectively operate without clogging or plugging.

Figure 4:
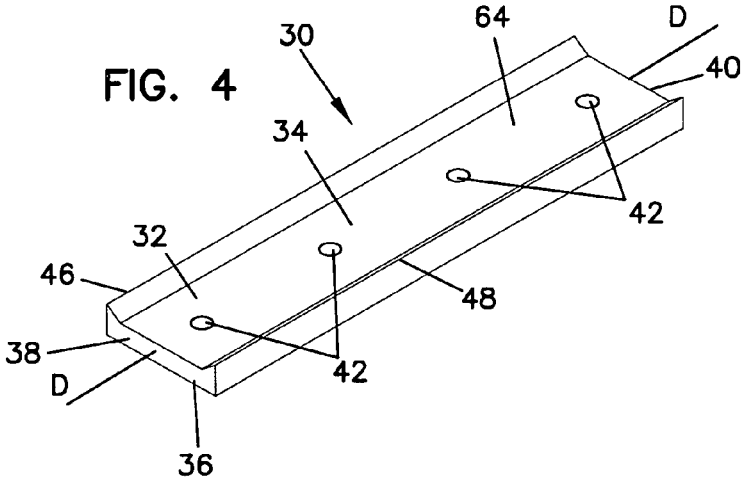
FIG. 4 is a perspective view of the anvil shown in FIG. 3.
Figure 5:
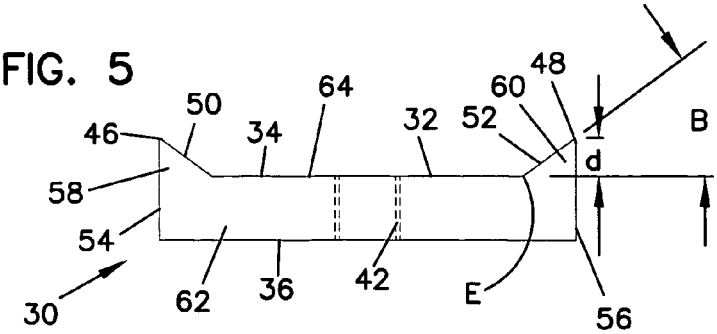
FIG. 5 is a side elevation view of the anvil of FIG. 4.

Referring to FIGS. 4 and 5, the snag anvil 30 includes a base 32 having a top surface 34 and a bottom surface 36. The top and bottom surfaces 34, 36 extend between a first end 38 and a second end 40 of the anvil 30. The top surface 34 of the base 32 defines a recessed impact plane or impact surface. The impact plane 34 is the primary plane or surface onto which impact forces from the hammers 20 are transferred. Mounting holes 42 are formed in the base 32. The mounting holes 42 are sized to receive fasteners for mounting the anvil 30 to a support member 44 (FIG. 3) located in the transition region 24.

As shown in FIG. 4, the anvil 30 includes first and second longitudinal edges 46, 48. The longitudinal edges 46, 48 extend between the first and second ends 38, 40 of the anvil 30. Each of the longitudinal edges 46, 48 are defined by the respective union or conjunction of ramped surfaces 50, 52 and side surfaces 54, 56. The side surfaces 54, 56 extend generally perpendicular to the impact plane 34 of the anvil. The ramped surfaces 50, 52 angle upward and away from the impact plane 34. Accordingly, the longitudinal edges 46, 48 of the anvil are located a distance d (FIG. 5) above the impact plane 34.

Referring back to FIG. 3, the ramped surfaces 50, 52 (as shown with regards to the second ramped surface 52) are angled upward from the impact plane 34 at an angle B projects outward below the central axis A of the drum 18. That is, when the anvil 30 is mounted relative to the drum 18, the central axis A of the drum is at an angle of about 40 degrees relative to an intersection E (FIG. 5) of the impact plane 34 and the ramped surface 52; the angle B of the ramped surface 52 is between about 40 degrees and 20 degrees; more preferably between about 40 degrees and 35 degrees. The angle B causes material passing over the anvil 30 at an excessive rate to snag, which in turn creates a more uniform and controlled material intake flow.

The illustrated embodiment of the anvil 30 having a particular ramped surface angle B of between about 40 and 35 degrees provides a particular snagging or retarding effect, i.e., a particular level or characteristic of material intake control. It is contemplated that the angle B of the ramped surfaces 50, 52 can be configured to provide less aggressive or more aggressive snagging or retarding effect to accommodate a particular machine or application in which the anvil will be used.

For example, when using hammers with particularly aggressive grinding tips, the ramped surfaces 50, 52 of the anvil 30 can be more aggressively angled (e.g., greater than 20 to 40 degrees) to cancel or balance the aggressive gripping of the hammers and provide a more controlled material intake. Likewise, when using hammers with less aggressive grinding tips, the ramped surfaces 50, 52 of the anvil 30 can be less aggressively angled (e.g., less than 20 to 40 degrees) to accommodate or balance the less aggressive gripping of the hammers. Accordingly, the angle B of the ramped surface 52 can be less than 20 degrees, for example, so long as a sufficient retarding or snagging effect can be achieved to prevent excessive material intake rates; yet in other embodiments, the angle B may be greater than the 40 degrees, so long as the hammers can adequately compensate for the more aggressive snagging characteristic.

Referring again to FIG. 5, the ramped surfaces 50, 52 and the side surfaces 54, 56 of the snag anvil 30 define triangular shaped portions 58, 60 that are integral with the base 32 of the anvil; the base 32 of the anvil 30 having a base portion 62 that is generally rectangular in shape. The triangular shaped portions 58, 60 are preferably integrally formed with the base 32 (i.e. a solid or monolithic construction) for purposes of structural strength. In an alternative embodiment, however, the triangular shaped portions or longitudinal edges of the anvil can be manufactured as separate pieces that are joined to the base 32 by fasteners or weldments, for example.

The triangular portions 58, 60 of the anvil 30 define an anvil tray or depression 64 (i.e., the recessed impact plane 34). The depression 64 is centrally located between the edges 46, 48, and extends between the first and second ends 38, 40 of the base 32. As shown in FIG. 3, the depression 64 in the anvil 30 is below a conveying plane C (see also FIG. 2) of the conveyor system 12 and the transition plate 26.

In particular, the anvil 30 is positioned in the transition region 24 of the grinding machine 10 such that the longitudinal edges 46, 48 of the anvil are at or flush with the conveying plane C of the conveying system 12 and transition plate 26; accordingly, the depression 64 or recessed impact plane 34 of the anvil 30 is located below the conveying plane C of the machine. Positioning the anvil 30 such that the depression 64 is below the conveying plane C accommodates the provision of the projecting longitudinal edge (e.g., 52) that snags material, without creating an obstacle in the conveying plane C that could inhibit transport of material to the grinding chamber 14. That is, the projecting longitudinal edges 46, 48 are preferably at or below the conveying plane C over which material passes so as to not impede the normal intake of material at a desired intake rate, while at the same time provide a snagging effect that prevents excessive material intake.

Referring again to FIGS. 4 and 5, the depression 64 of the anvil 30 is symmetrically located along a central longitudinal axis D of the anvil. The longitudinal edges 46, 48 are also symmetrically located in relation to the longitudinal axis D of the anvil 30. This arrangement permits a user to reverse the anvil 30 when one of the longitudinal edges becomes worn. That is, the anvil 30 can be reversibly mounted to the grinding machine in either of both of a first orientation and a second orientation (the first longitudinal edge 46 being oriented toward the grinding chamber 14 in the first orientation, and the second longitudinal edge 48 being oriented toward the grinding chamber 14 in the second orientation). To accommodate the reversible feature the present anvil, the mounting holes 42 of the anvil are also symmetrically located in the base 32 of the anvil so that the anvil 30 can be mounted in either one of both of the first and second orientations.

As can be understood, the longitudinal edges 46, 48 are relatively sharp and non-chamfered, as provided by the structural intersection of the ramped surfaces 50, 52 and the side surfaces 54, 56 of the anvil. The longitudinal edges 46, 48 of the disclosed anvil 30 are preferably of a sufficient sharpness to aid in preventing material from entering the grinding chamber 14 at a rate too great for the machine's grinding capacity. It is contemplated that the edges of the anvil can be manufactured to a particular sharpness, such as by machining, for example. In some embodiments, the combination of the angle B of the ramped surfaces 50, 52, and the sharpness of the longitudinal edges 46, 48 can be provided in collaboration with one another to control the material intake rate.

For example, the ramped surfaces 50, 52 of the anvil 30 can be provided with a less aggressive angle B, in combination with sharper, longitudinal edges 46, 48 to produce a particular degree of material intake control. Yet, the ramped surfaces 50, 52 of the anvil 30 can also be provided with a more aggressive angle B, in combination with less sharp, longitudinal edges 46, 48 to produce the same particular degree of material intake control. Modifying either the angle B of the surfaces 50, 52, or the sharpness of the edges 46, 48, will create an accordingly more or less aggressive intake control characteristic. The snag anvil 30 can thereby be adapted to effectively control material intake in a variety of chipping/grinding applications.

Conventional anvil arrangements do not resist rapid material intake rates. Chamfered corners on conventional anvils, for example, provide no resistance to rapid movement of material into a grinding chamber. The present anvil 30 snags and retards the movement of material that is pulled across the anvil when the movement becomes too rapid. Material plugging and subsequent engine stall are thereby avoided.

As can be understood, wear on the longitudinal edges 46, 48 of the present anvil can reduce the effectiveness of the control of material intake. The reversibility of the present snag anvil 30 provides a user with longer productive use of the anvil. To further enhance the life of the anvil 30, the longitudinal edges 46, 48 can be manufactured to provide protection from wear. Such protection can include heat treating the entire anvil 30, case hardening the snag edges 46, 48, providing a hard-face weld overlay of various materials, and/or involve a tungsten carbide impregnating process, for example.

Referring back to FIGS. 2 and 3, in use, the reversible anvil 30 is mounted in a horizontal orientation. In particular, the anvil 30 is selectively oriented in one of either the first horizontal orientation or the second horizontal orientation previously described. In FIG. 3, the anvil 30 is mounted in the second orientation, i.e., with the second longitudinal edge 48 positioned toward the grinding chamber 14; although the feature of the anvil being selectively oriented means that the first longitudinal edge 46 could also be operatively positioned toward the grinding chamber 14 to provide controlled material intake. When the anvil 30 has been selectively oriented, the reversible anvil is then secured or mounted to the support member 44. If the anvil becomes worn, the anvil can be detached from the support member 44, reversed, and re-mounted in the other of the first and second orientations for continued use.

Figure 6:
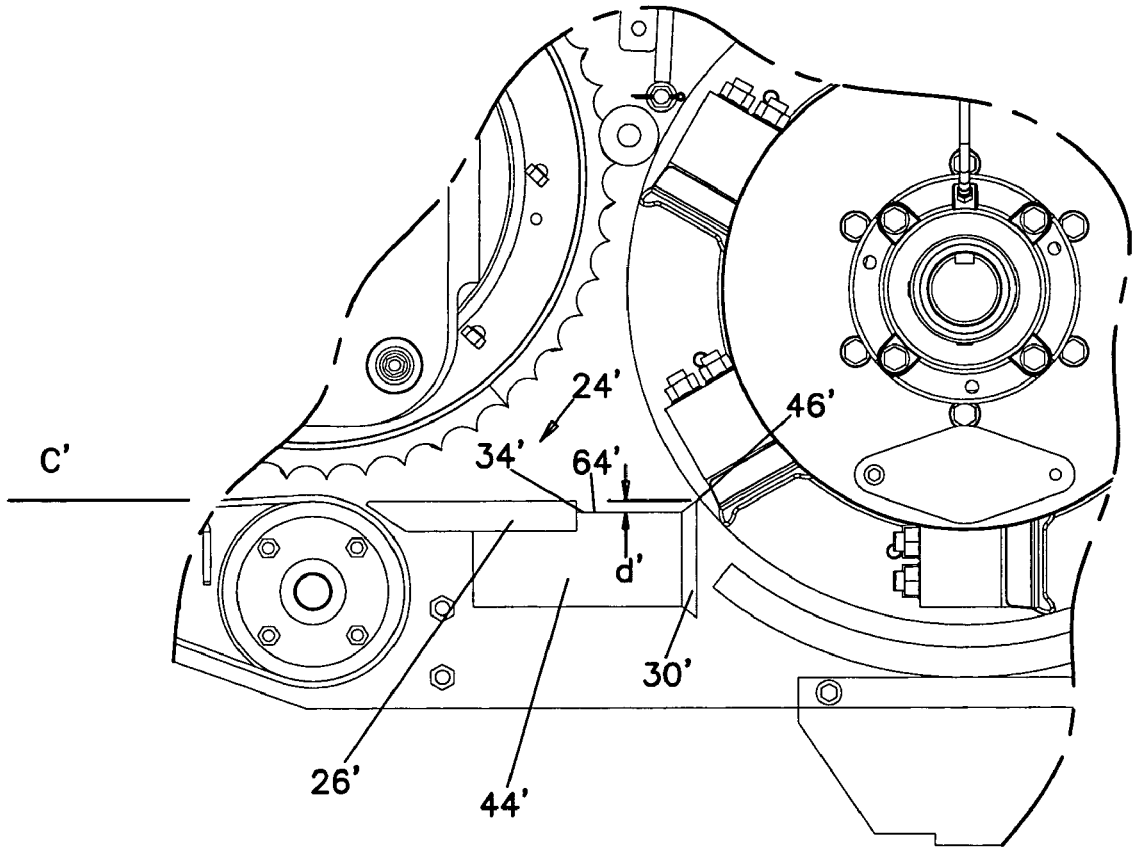
FIG. 6 is partial side elevation view of the grinding machine of FIG. 1, having an alternative embodiment of an anvil in accordance with the principles disclosed.
Figure 7:
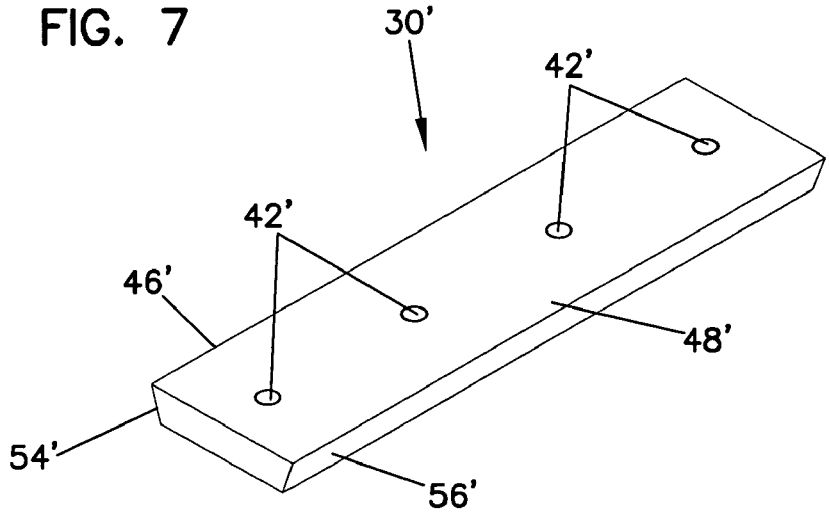
FIG. 7 is a perspective view of the anvil of FIG. 6.

Referring now to FIGS. 6 and 7, an alternative embodiment of an anvil 30' incorporating the principles presently disclosed is illustrated. In this embodiment, the anvil 30' is mounted to a support member 44' in a vertical orientation, as opposed to a horizontal orientation. In contrast to the previous embodiment, the anvil 30' does not include a depression 64'. The depression 64' is instead defined by the support member 44' in a transition region 24' of the grinding machine. The depression could also be similarly formed in an extension of the transition plate (e.g., 26'), for example. Similar to the previous embodiment, the depression 64' in the transition region 24' functions as a recessed impact plane 34'. The recessed impact plane 34' is provided below the conveying plane C' of the grinding machine.

Referring to FIG. 7, the anvil 30' includes opposing first and second longitudinal edges 46', 48'. The longitudinal edges 46', 48' are defined by angled side surfaces 54', 56'. When mounted in the transition region 24', the longitudinal edge (e.g., 46') extends upward and away from the depression 64'. Accordingly, the longitudinal edge 46' of the anvil 30' is located a distance d' (FIG. 6) above the impact plane 34', and is also preferably located at or below the conveying plane C' of the machine.

The angle side surfaces 54', 56' can be similarly configured as described with respect to the angle B of the ramped surfaces of the previous embodiment to produce a snagging effect on material passing over the anvil 30'. It is to be understood that the principles and features of the recessed impact plane 34, the angular configurations of the anvil, and sharpness and location of the longitudinal edges with respect to the conveying plane C (FIG. 2) of the grinding machine, as described with respect to the previous embodiment similarly apply to the embodiment shown in FIGS. 6 and 7. For example, in keeping with the principles disclosed, the vertically mounted anvil 30' is a reversible anvil including symmetrically arranged mounting holes 42' that permit a user to reverse the anvil when the first longitudinal edge 46', for example, becomes worn.

II. Open Feed Roller

Another of the features of the present grinding machine 10 relates to an upper feed roller 72 (FIG. 2) that prevents an undesirable operating condition and/or stalling of the conveying system 12. Referring back to FIGS. 1 and 2, the conveying system 12 of the present grinding machine 10 includes a lower feed conveyor 70 (FIG. 1) and the upper feed roller 72 (FIG. 2). The upper feed roller 72 is partly enclosed by a portion of the housing 16, e.g., a shoot or shroud 28.

The shoot 28 of the housing 16 has sidewalls 92 (see also FIG. 9) that contain and direct the incoming material being transported by the conveying system 12. The upper feed roller 72 is located between the sidewalls 92 of the shoot 28. Clearance gaps G (FIG. 9) are provided between the sidewalls 92 and each of a first open end 66 and a second open end 68 (see FIG. 8) of the roller 72.

During operation, material can sometimes pass through the gaps G and enter into the open ends 66, 68 of the roller 72. In conventional arrangements, such wayward material would otherwise be trapped within the end of the roller due to the proximity of the ends 66, 68 to the shoot sidewalls 92. As the trapped material collects, the increasing volume of material within the roller 72 begins to drag or scrape against the sidewalls 92 and/or other internal structure or components. The scraping and frictional drag impedes the efficient operation of the conveying system. Sometimes material can even jam between the roller 72 and the sidewall 92, possibly causing the conveying system to stall. The upper feed roller 72 of the present grinding machine 10 has an open construction that provides a path of escape for wayward material that would otherwise impede operation of the conveying system.

Figure 8:
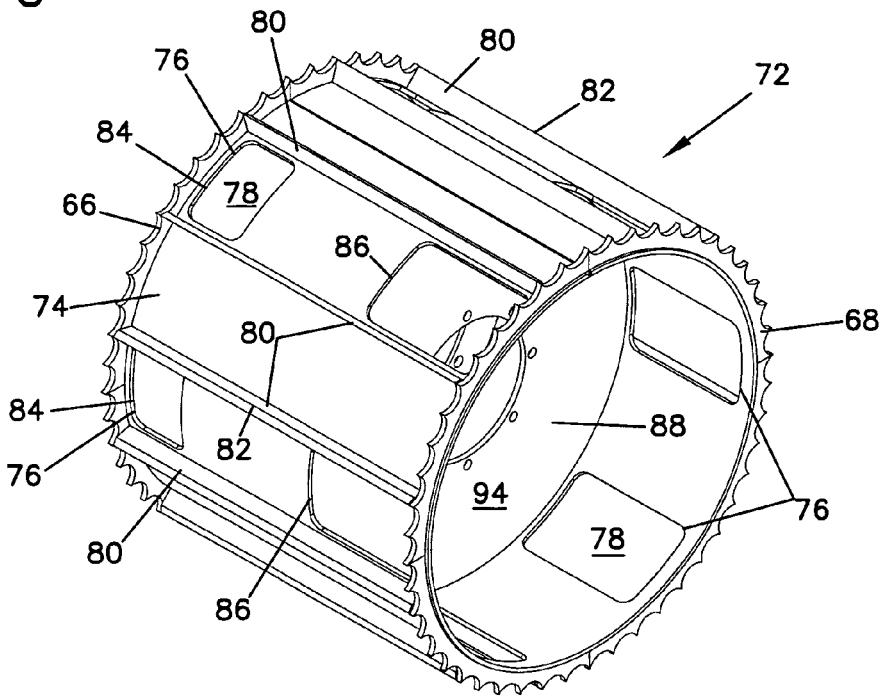
FIG. 8 is a perspective view of the upper feed roller shown in FIG. 2.

In particular, as shown in FIG. 8, the upper feed roller 72 of the present disclosure has a cylindrical wall 74 that defines a number of large openings 76. The cylindrical wall 74 extends between the first open end 66 of the roller 72 and the second open end 68. The large openings 76 of the upper feed roller 72 permit material to pass through the openings so that wayward material does not become trapped within the upper feed roller 72. In the illustrated embodiment, the large openings 76 include two large-sized openings 76, specifically first large-sized openings 84 and second large-sized openings 86. What is meant by large openings or large-sized openings is that the openings each have a cross-sectional area 78 of at least 6.0 square inches; more preferably at least 9.0 square inches.

Figure 9:
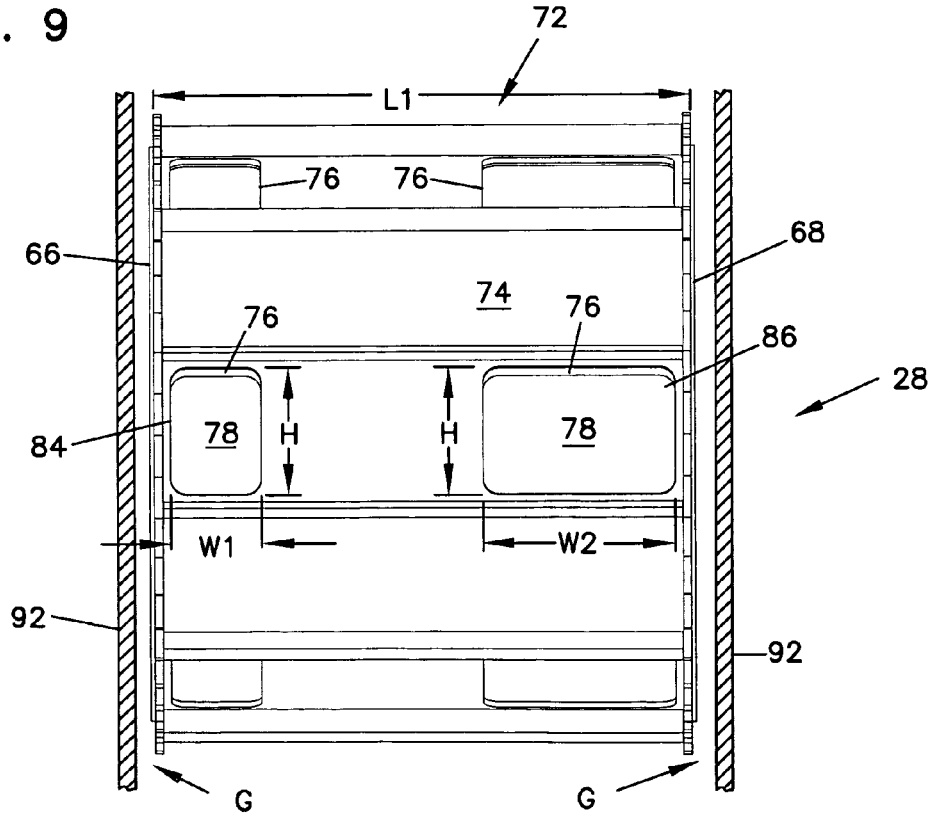
FIG. 9 is a front elevation view of the upper feed roller of FIG. 8.

Referring now to FIG. 9, in the illustrated embodiment, the first large-sized openings 84 have a height H, and a first width W1. The first width W1 of the first large-sized openings 84 is preferably between about 2.5 and 4.0 inches; more preferably between about 3.0 and 3.5 inches. The height H of the first large-sized openings 84 is preferably between about 3.0 and 4.0 inches. The cross-sectional area 78 of each of the first large-sized opening 84 is preferably at least 6.0 square inches; more preferably at least 9.0 square inches, as previously described.

Similarly, the second large-sized openings 86 have a height H, and a second width W2. The second width W2 of the second large-sized openings 86 is preferably between about 5.5 and 7.0 inches; more preferably between about 6.0 and 6.5 inches. The height H of the second large-sized openings 84 is essentially the same as the first large-sized opening, i.e., preferably between about 3.0 and 4.0 inches. The cross-sectional area 78 of each of the second large-sized opening 86 is preferably at least 16 square inches; more preferably at least 20 square inches.

The large openings 76 are located between alternating rows of gripping knives 80. The gripping knives 80 have sharp edges 82 that grip material for conveyance of the material into the grinding chamber 14. Each of the first large-sized openings 84 is located in a circumferential column adjacent to the first end 66 of the roller 72. Each of the second large-sized openings 86 is located in a circumferential column adjacent to the second end 68 of the roller 72. In the illustrated embodiment, the upper feed roller 72 includes six, first large-sized openings 84 and six, second large-sized openings 82, for a total of twelve large openings 76.

The circumference of the cylindrical wall 74 of the illustrated roller 72 is approximately 18 inches in diameter. The length L1 of the roller, defined between the first end 66 and the second end 68, is approximately 16.5 inches. In one embodiment, the total cross-sectional area of the twelve large openings 76 is between about 15 and 20 percent of the overall circumferential surface area of the cylindrical wall 74 of the roller; the percentage of open area being defined by only the twelve large openings 76.

The widths W1, W2 of each of the large openings 76 generally corresponds to the depth of an interior region 94 (FIG. 8) located at each of the open ends 66, 68 of the roller 72. The depth of the interior region 94 of the second open end 68, for example, is determined by the location of an inner roller drive plate 88. The depth of the interior region 94 of the first open end 66 is similarly determined by the location of another inner roller drive plate (not shown). Referring to FIG. 2, the inner roller drive plates 88 of the upper feed roller 72 are interconnected to an arm 90 of the conveyor system 12, which rotational drives the upper feed roller 72 and positions the roller in relation to the lower feed conveyor 70. The height H of the large openings 76 generally corresponds to the placement of the gripping knives 80. As can be understood, in alternative embodiments, the large openings can be of different sizes depending upon the structural design of the roller. That is, the openings 76 can be made smaller or larger depending upon the number, size, and placement of gripping knives 80 and the provision and/or location of the inner roller drive plates 88, for example. Likewise, the number of openings 76 can also be varied. Preferably, however, the size and number of openings provided allows material to pass through the roller 72 to prevent the collection of material within the interior region of the open ends of the roller.

III. Chip Control Seal

Figure 10:
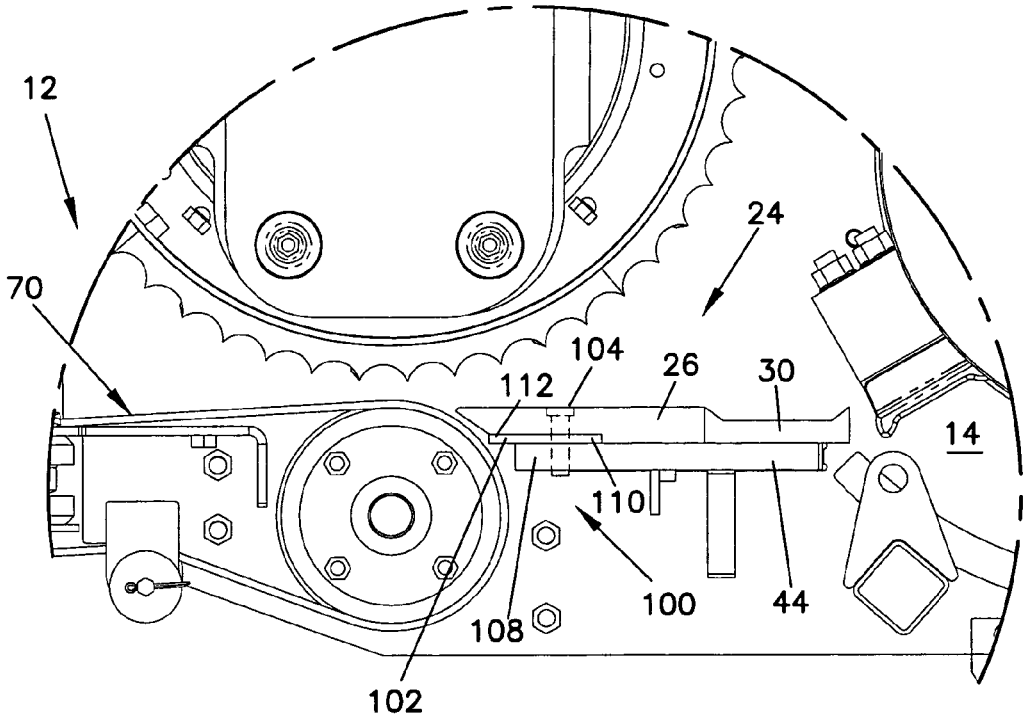
FIG. 10 is an enlarged, detailed view of the grinding machine of FIG. 2, taken from circled detail Y.

Still another feature of the present grinding machine 10 relates to a sealing arrangement 100 (FIG. 10) that eliminates undesired chip or material buildup underneath the grinding machine 10 during operation. Referring to FIG. 10, the sealing arrangement 100 is located between the grinding chamber 14 and the conveying system 12 of the machine 10. In particular, the sealing arrangement 100 is located in the transition region 24 adjacent to the lower feed conveyor 70 of the conveying system 12. The sealing arrangement 100 includes a seal 102 that prevents material from falling between the lower feed conveyor 70 and the transition plate 26. The seal 102 eliminates material build up and chip piles under the machine that can occur without such a sealing arrangement 100.

Figure 11:
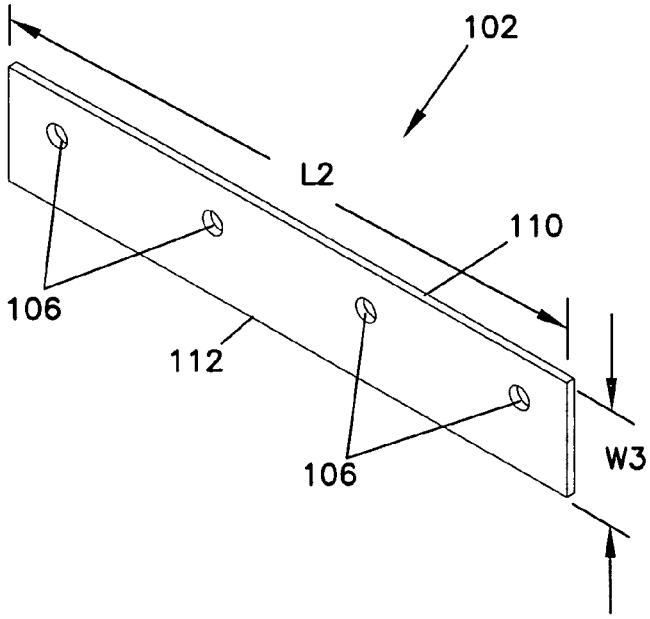
FIG. 11 is a perspective view of a chip control seal shown in FIG. 10.

As shown in FIG. 11, the seal 102 has a length L2 that spans across the width of the lower feed conveyor 70. Preferably, the seal 102 is made of a material that is rigid enough to prevent material from passing through the space between the transition plate 26 and the lower feed conveyor 70, yet flexible enough to allow a belt joint (not shown) of the lower feed conveyor 70 to pass by the seal 102. In the illustrated embodiment, the seal 102 is made of a rubber material; although other types of material can be used.

The seal 102 includes guide holes 106 (FIG. 11) sized to receive fasteners 104 (FIG. 10). The fasteners 104 secure the transition plate 26 to the support member 44. The seal 102 is clamped between the transition plate 26 and the support member 44, the fasteners 104 extending through the guide holes 106 of the seal 102 to further secure the seal in relation to the lower feed conveyor 70. Other mounting arrangements can be used to secure the seal 102 in relation to the lower feed conveyor 70.

In the illustrated embodiment of FIG. 10, the support member 44 has an extended portion 108 that supports a majority of a width W3 (FIG. 11) of the seal 102. In particular, the extended portion 108 supports the seal 102 from a clamped end 110 to a point proximate a free end 112. Supporting the rubber seal 102 proximate the free end 112 provides added sealing strength and rigidity to prevent material from passing between the lower feed roller and grinding chamber 14.

IV. Alternative Machine Embodiments

Figure 12:
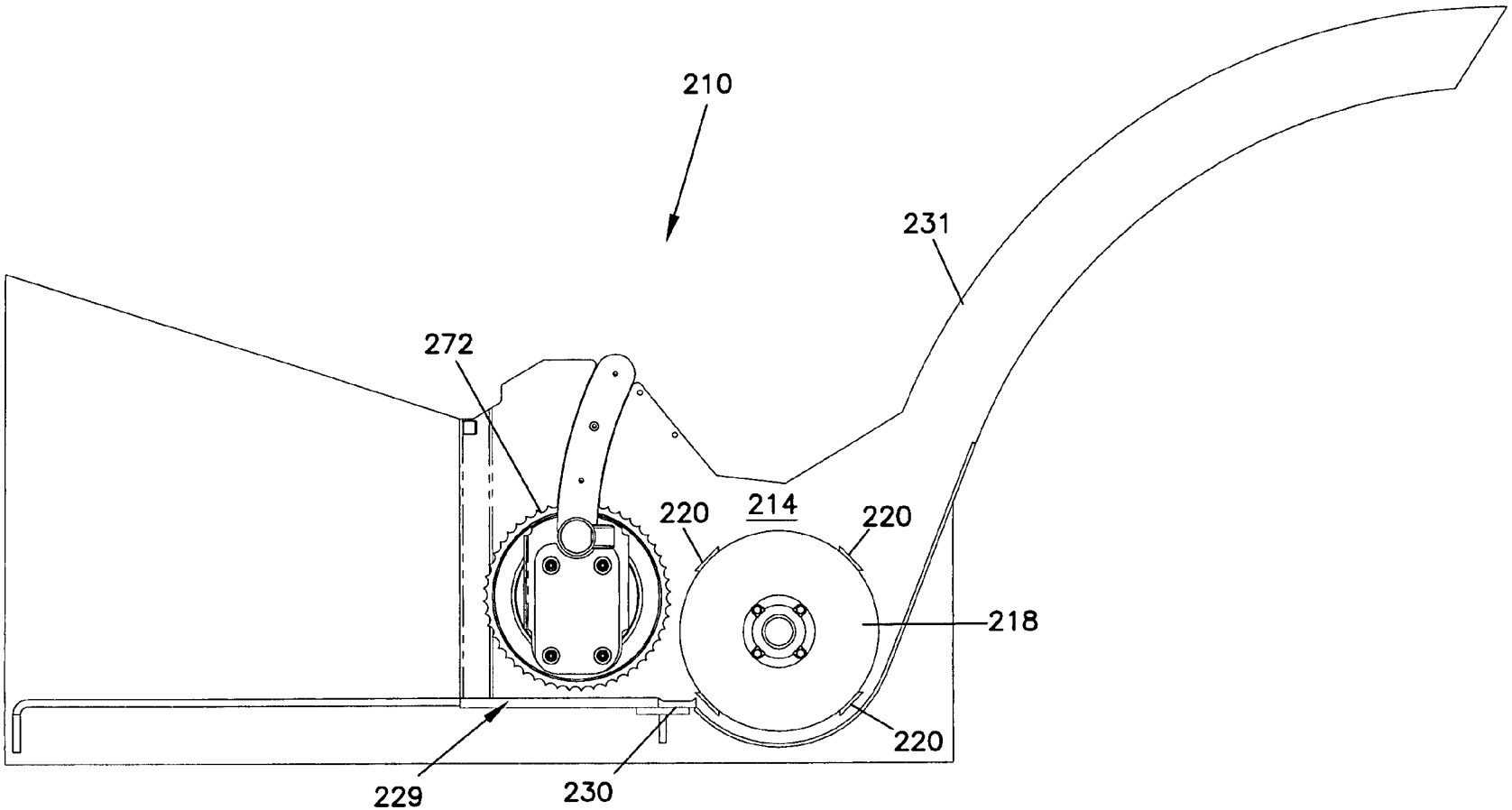
FIG. 12 is a perspective view of one embodiment of a chipper machine incorporating an anvil, in accordance with the principles disclosed.

Referring now to FIG. 12, another embodiment of a machine 210 having features in accordance with the principles of the present disclosure is illustrated. The machine 210 is a chipper machine having similar theories of operation to that of the previously described grinding machine 10. It is to be understood that the features previously described with respect to the grinding machine 10, similarly apply to the chipper machine 210.

For example, the present chipper machine 210 includes a snag anvil 230 that is adapted to prevent an undesired rapid feed rate of material into a chipping chamber 214 of the chipper machine 210. The snag anvil 230 is located between the chipping chamber 214 and a region 229 where material is input into the chamber 214. Material can be manually input into the region 229 via a shoot, for example, (as shown in FIG. 12); or automatically input into the region 229 via a conveying system.

The anvil 230 is positioned adjacent to a drum 218 in the chipping chamber 214. The drum includes chipping knives 220. The anvil 230 accommodates impact forces produced by the chipping knives 220 and transferred through the material. Preferably, the anvil 230 is constructed and arranged as previously described with regards to the anvil 30 of FIGS. 3-5. The anvil 230 thereby reduces the occurrence of exceeding a desired incoming material feed rate of the chipper machine 210, and provides a more controlled and uniform flow of material into the chipping chamber 214 so that the knives 220 can effectively operate without clogging or plugging. In operation, the drum 218 rotates; the impact from the rotating knives 220 on the material shreds, chips, and/or grinds the incoming material. The ground material exits the chipping chamber 214 through shoot 231.

The chipping machine 210 can also include a feed roller 272 designed with large openings, which provide a path of escape for wayward material that would otherwise create an undesirable operating condition. That is, the roller 272 can be constructed and arranged, as previously described with regards to the roller 72 of FIGS. 8 and 9. In addition, although not shown, the chipper machine 210 can also include a sealing arrangement, as previously described, that eliminates undesired chip or material buildup underneath the chipper machine 210.

The above specification provides a complete description of the present invention. Since many embodiments of the invention can be made without departing from the spirit and scope of the invention, certain aspects of the invention reside in the claims hereinafter appended.

What is claimed is:

1. A grinding machine, comprising:

a) a grinding chamber including a grinding drum;

b) a conveying system that transports material to the grinding chamber, the conveying system defining a conveying plane; and c) an anvil located between the grinding chamber and the conveying system, wherein material fed into the grinding chamber by the conveying system passes over the anvil, the anvil including:

i) a base portion having a first end, a second end, and side surfaces extending between the first and second ends, the base portion defining a recessed impact plane, the recessed impact plane being located below the conveying plane of the conveying system;

ii) a ramped surface extending upward from the recessed impact plane of the base portion; and iii) a longitudinal edge defined by the conjunction of the ramped surface and one of the side surfaces, the longitudinal edge being located a distance above the recessed impact plane, the longitudinal edge further being located at or below the conveying plane of the conveying system.

2. The grinding machine of claim 1, wherein the longitudinal edge of the anvil is generally flush with the conveying plane of the conveying system.

3. The grinding machine of claim 1, wherein the longitudinal edge of the anvil extends from the first end of the anvil to the second end.

4. The grinding machine of claim 1, wherein the ramped surface of the anvil extends upward from the base at an angle of between about 20 and 40 degrees relative to the recessed impact plane.

5. The grinding machine of claim 1, wherein the base portion is generally rectangular, and wherein the ramped surface at least partially defines a triangular portion of the anvil, the triangular portion being formed integral with the base portion.

6. The grinding machine of claim 1, wherein the longitudinal edge is a first longitudinal edge defined by the conjunction of a first ramped surface and one of the side surface, the anvil further including a second longitudinal edge defined by the conjunction of a second ramped surface and the other of the side surfaces, the second longitudinal edge being located a distance above the recessed impact plane.

7. The grinding machine of claim 6, wherein the anvil further includes mounting structure arranged so that the anvil can be reversibly mounted between the grinding chamber and the conveying system in either of both of a first orientation and a second orientation.

8. A grinding machine, comprising:

a) a grinding chamber including a grinding drum;

b) an incoming material region defining a material conveying plane; and c) an anvil located within the incoming material region, the anvil being positioned to receive the primary impact forces of the grinding drum, the anvil including:

i) a base portion defining a recessed impact plane, the recessed impact plane being located beneath the material conveying plane of the incoming material region; and ii) a ramped surface extending outward from the recessed impact plane to a longitudinal edge located a distance from the recessed impact plane, the longitudinal edge being located at or below the conveying plane of the incoming material region, and the anvil being positioned such that the longitudinal edge is located between the recessed impact plane and an entry to the grinding chamber.

9. The grinding machine of claim 8, further including a conveying system that transports material along the material conveying plane of the incoming material region.

10. The grinding machine of claim 9, wherein the longitudinal edge of the anvil is generally flush with the material conveying plane.

11. The grinding machine of claim 8, wherein the longitudinal edge extends from a first end of the base portion to a second opposite end of the base portion.

12. The grinding machine of claim 8, wherein the ramped surface of the anvil extends outward from the base portion at an angle of between about 20 and 40 degrees relative to the recessed impact plane.

13. The grinding machine of claim 8, wherein the base portion is generally rectangular, and wherein the ramped surface at least partially defines a triangular portion of the anvil, the triangular portion being formed integral with the base portion.

14. The grinding machine of claim 8, wherein the ramped surface is a first ramped surface and wherein the longitudinal edge is a first longitudinal edge, the anvil including a second ramped surface extending to a second longitudinal edge located a distance from the recessed impact plane.

15. The grinding machine of claim 14, wherein the anvil is reversible such that the anvil mounts in both a first orientation having the first longitudinal edge adjacent the entry to the grinding chamber, and a second orientation having the second longitudinal edge adjacent the entry to the grinding chamber.

16. The grinding machine of claim 8, wherein the anvil is mounted below a horizontal plane that extends through a central axis of the grinding drum.

17. The grinding machine of claim 8, wherein the ramped surface extends upward from the recessed impact plane, and wherein the primary impact forces delivered by the grinding drum to the anvil are generally downward impact forces.

18. A machine, comprising:

a) a chamber including a drum that rotates about a central axis, the drum including a plurality of cutting elements;

b) an incoming material region defining a material conveying plane; and c) an anvil located within the incoming material region, the anvil being positioned to receive the primary impact forces of the drum, the anvil including:

i) a base portion defining a recessed impact plane, the recessed impact plane being located beneath the material conveying plane of the incoming material region; and ii) a ramped surface extending outward from the recessed impact plane to a longitudinal edge located a distance from the recessed impact plane, the longitudinal edge being located at or below the conveying plane of the incoming material region, and the anvil being positioned such that the longitudinal edge is located between the recessed impact plane and an entry to the chamber.

19. The machine of claim 18, further including a conveying system that transports material along the material conveying plane of the incoming material region.

20. The machine of claim 19, wherein the longitudinal edge of the anvil is generally flush with the material conveying plane.

21. The machine of claim 18, wherein the longitudinal edge extends from a first end of the base portion to a second opposite end of the base portion.

22. The machine of claim 18, wherein the ramped surface of the anvil extends outward from the base portion at an angle of between about 20 and 40 degrees relative to the recessed impact plane.

23. The machine of claim 18, wherein the base portion is generally rectangular, and wherein the ramped surface at least partially defines a triangular portion of the anvil, the triangular portion being formed integral with the base portion.

24. The machine of claim 18, wherein the ramped surface is a first ramped surface and wherein the longitudinal edge is a first longitudinal edge, the anvil including a second ramped surface extending to a second longitudinal edge located a distance from the recessed impact plane.

25. The machine of claim 24, wherein the anvil is reversible such that the anvil mounts in both a first orientation having the first longitudinal edge adjacent the entry to the grinding chamber, and a second orientation having the second longitudinal edge adjacent the entry to the grinding chamber.

26. The machine of claim 18, wherein the anvil is mounted below a horizontal plane that extends through the central axis of the drum.

27. The machine of claim 18, wherein the ramped surface extends upward from the recessed impact plane, and wherein the primary impact forces delivered by the drum to the anvil are generally downward impact forces.

* * * * *